United States Patent [19]

Swiatosz et al.

[11] 4,265,238

[45] May 5, 1981

[54] SIMULATED OXYGEN BREATHING APPARATUS

[75] Inventors: Edmund Swiatosz, Maitland; Wiley V. Dykes; Paul D. Grimmer, both of Winter Park; Bruce V. Lane, Palm Bay, all of Fla.

[73] Assignee: The United States of America as represented by the Secretary of the Navy, Washington, D.C.

[21] Appl. No.: 66,944

[22] Filed: Aug. 16, 1979

[51] Int. Cl.[3] ..... A62B 7/00

[52] U.S. Cl. ..... 128/205.12; 128/200.24; 128/205.13

[58] Field of Search ..... 128/202.26, 203.28, 128/205.12, 205.13, 205.17, 205.25, 205.29, 206.12, 206.15, 206.17, 204.21, 205.28, 205.24, 201.25

[56] References Cited

U.S. PATENT DOCUMENTS

| | | | |
|---|---|---|---|
| 1,508,970 | 9/1924 | Guillemard | 128/205.28 |
| 3,202,150 | 8/1965 | Miller | 128/205.25 X |

FOREIGN PATENT DOCUMENTS

| | | | |
|---|---|---|---|
| 2856503 | 7/1979 | Fed. Rep. of Germany | 128/205.28 |
| 438980 | 11/1935 | United Kingdom | 128/205.13 |

*Primary Examiner*—Henry J. Recla

*Attorney, Agent, or Firm*—Richard S. Sciascia; Robert W. Adams

[57] ABSTRACT

A filter replaces the oxygen canister of an oxygen breathing apparatus and the air flow path is modified to provide a realistic simulation for training personnel in the use of closed circuit breathing units.

8 Claims, 6 Drawing Figures

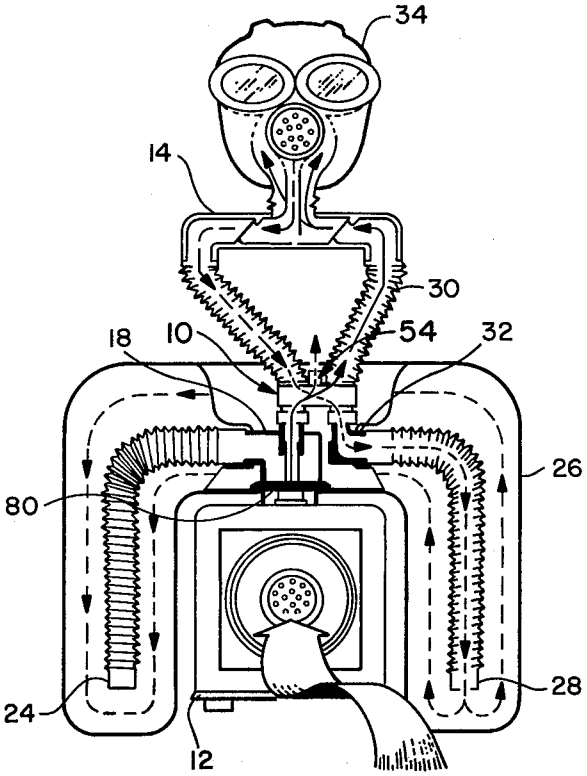
FIG. 1
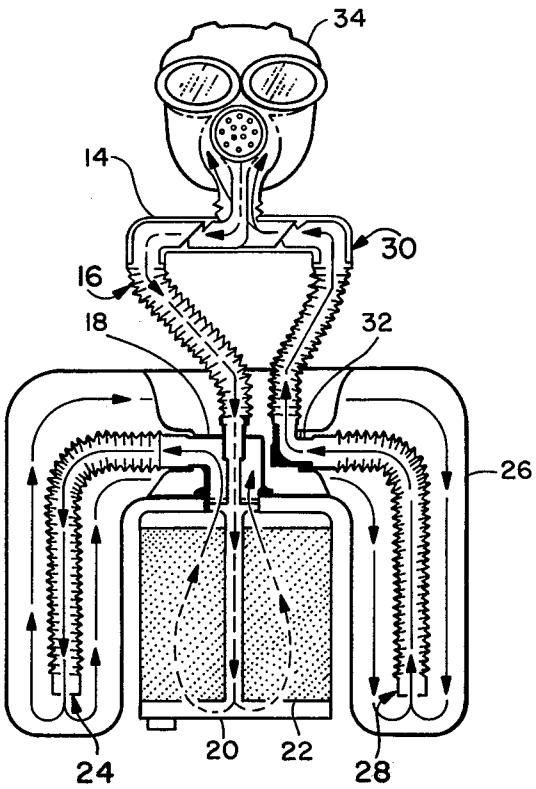
PRIOR ART

SIMULATED OXYGEN BREATHING APPARATUS

BACKGROUND OF THE INVENTION

Emergency situations are best handled by personnel skilled in competent procedures that have been acquired through experience and training. The best insurance is good preparation.

Many emergencies require that the responding personnel be provided breathing apparatus to cope with toxic environments. Fires, chemical leaks, explosive atmospheres and underground operations are obvious, critical environments where breathing assistance is needed. In such cases the operator must be confident in the apparatus and his own ability to operate it safely and effectively. Otherwise, his attention to the task at hand will suffer in the emergency.

For perfect realism, the apparatus itself would be used in training. Inasmuch as containers of oxygen are used with oxygen breathing apparatuses, cost becomes a significant factor, however, and therefore simulation is encouraged. Accordingly, the next best thing to the perfect realism of the apparatus itself is the apparatus, slightly modified for training. That is what the present invention provides, with an insignificant loss in realism.

The prior art is devoid of any teaching that pertains to the simulation of closed loop breathing apparatuses. This is probably true because until now training procedures have employed the apparatus itself. With the significant risk of injury that inherently accompanies dealing in an oxygen rich atmosphere and the caustic chemicals that are used to emit oxygen in a closed loop system, in addition to the substantial expense that results when numerous training sessions are undertaken, the use of operational equipment is undesirable, however. Inversely, it is desirable to simulate operation for training.

Oxygen breathing apparatuses (OBA's) for the most part are closed loop systems which are not vented except by a relief valve. Other apparatuses are filtering arrangements that often include chemical bags for removing a substantial segment of the irritants out of the air. OBA's were the application for which the present invention was originated. The techniques disclosed, however, have application to the filtering apparatuses too.

The present invention was originally designed for use in conjunction with the commonly used military OBA that is designated the Type A-3. It produces its own oxygen and enables the wearer to enter compartments, voids or tanks which contain smoke, dust or fire, or which have low oxygen supply. The Type A-3 is shown in the drawings, identified as Prior Art. The modifications of the OBA which are indicative of the present invention are shown in FIG. 1. The Type A-3 has a facepiece section that houses the eyepieces, the speaking diaphragm, and head straps. The speaking diaphragm permits the wearer to talk to others and to use communication equipment, such as sound powered phones. The inverted T-tube couples the facepiece to the breathing bag assembly and uses three valves to control the flow of air to and from the facepiece. Two of the valves are flapper type check valves, one each on the input and output sides of the tube, and the other is a vent valve for partially deflating the breathing bag if breathing becomes difficult due to overinflation. The breathing tubes and bags store and supply air to and from the facepiece via the T-tube. The air flow path is shown by the arrows. Dash lines with arrows follow exhaled breath through the canister into the right side of the breathing bag, then to the left side of the breathing bag where the solid line with arrows traces the flow of fresh air through the inhalation process. Exhaled air is recharged by the potassium super oxide contained in the replaceable canister and recirculated to inflate the bag and supply fresh air to the facepiece. Rising upward from the bottom of the canister, the exhaled air is cleansed of its carbon dioxide by the chemical and takes on fresh oxygen. To keep the eyeglasses of the facepeice from fogging, the circulating air is directed past the eyepieces before it reaches the mouth. The breathing bag tubes are long to both support the bags, preventing their complete collapse, and cool the air which becomes quite warm in the canister, before it reaches the wearer.

The initial supply of oxygen is provided by a chlorate candle that is activated by withdrawing a lanyard once the canister is firmly sealed in place. The candle is soon extinguished, but by then the operator's respiration insures that oxygen will continue to be generated.

The present invention permits the original equipment to be used, slightly modified, to preserve realistic fit, feel and operation for training in both the use and the procedures for using the equipment. Equally important, the present invention does not restrict the training to a particular setting but permits it to be rendered on board ship, for example, where the actual emergency might occur. Along with the simulation in the equipment, it is expected that most of the conditions of the emergency would be simulated too. For example, "smoke" or "toxic fumes" would likely be a relatively harmless chemical cloud, as insurance for the safety of the personnel and for simplicity and controllability. The "emergency" is a training procedure, after all, designed to prevent injury or minimize damage, not cause them.

BRIEF DESCRIPTION OF THE DRAWINGS

The prior art figure shows an example of a breathing apparatus out of the prior art for which the techniques of the present invention can be used:

FIG. 1 shows the apparatus of the prior art figure modified by the techniques of the present invention;

DESCRIPTION OF A PREFERRED EMBODIMENT

Figure 2:
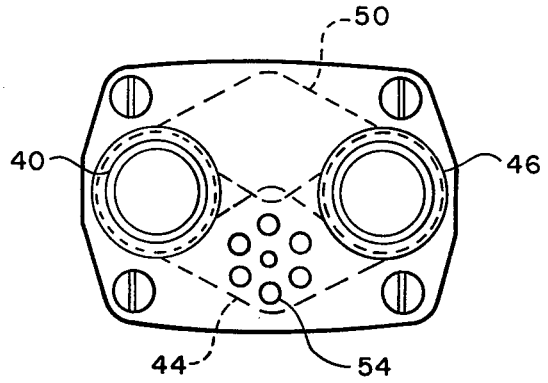
FIG. 2 shows a top view of the cross-over adapter of FIG. 1.

The prior art figure shows the Type A-3 Oxygen Breathing Apparatus (OBA) that is commonly used by the U.S. Navy. The present invention is a technique for simulating such apparatuses. The present invention, as applied to the Type A-3 OBA, is shown in FIG. 2.

In FIG. 1, the structural elements that permit the reversible conversion of the Type A-3 OBA to a simulator are cross-over 10 and canister 12. Cross-over 10 does not have a counterpart in the operational A-3 and is employed to redirect the air flow path, as will be discussed below. Canister 12 is a replacement for the chemical filled canister that is used in the operational equipment and is made to duplicate the size, shape, and weight of the operational canister. To the wearer, the simulator operates and feels like the operational equipment.

The airflow path of the operational Type A-3 OBA is shown in the prior art figure. Beginning at the facepiece, exhaled breath, shown by a broken line, is directed by inverted T-tube 14 through flexible exhalation tube 16 to fixture 18. Canister 20 abuts fixture 18 and provides a path for the exhaled air to the bottom of the canister. The depleted air is recharged as it passes through chemical 22, and fed into breathing bag tube 24 by fixture 18. Out the left tube, around bag 26, and up through right breathing bag tube 28, the replenished air is provided to inhalation tube 30 by fixture 32. T-tube 14 couples the air to facepiece 34.

The air flow path for the simulator of FIG. 1 is different. Fresh air is channeled from canister 12 through fixture 18 into cross-over 10, where it is diverted into inhalation tube 30. Exhaled breath is diverted from exhalation tube 16 into fixture 32 by cross-over 10. From fixture 32, the exhaled air is conducted by tube 28 into bag 26. The expired air fills the bag, simulating the feel and appearance of the operational equipment, which would be filled with oxygen.

Figure 3:
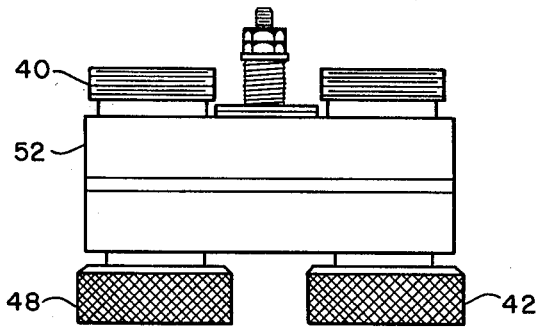
FIG. 3 shows a side view of the cross-over adapter of FIG. 1.

Cross-over 10 is shown in FIG. 2, and FIG. 3. Male coupler 40 communicates with female coupler 42 by means of channel 44. Likewise, male coupler 46 communicates with female coupler 48 via channel 50. The channels are formed in the upper and lower blocks of housing 52 and rendered communicative when the blocks are united to form the cross-over. A vent is provided at vent 54 to exhaust exhaled breath to the outside. The vent is resistive, to cause the breathing bag to inflate. The cross-over is one member of a two member modification set that permits the air flow path to be reversed in the breathing bags without causing noticeable change as seen by the wearer. The other member is canister 12.

Figure 4:
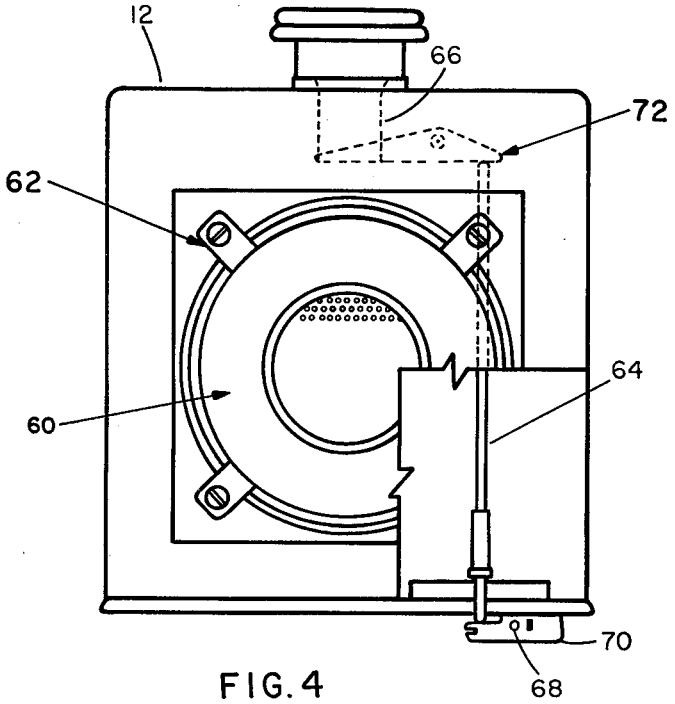
FIG. 4 shows a frontal view of the simulated canister of FIG. 1.
Figure 5:
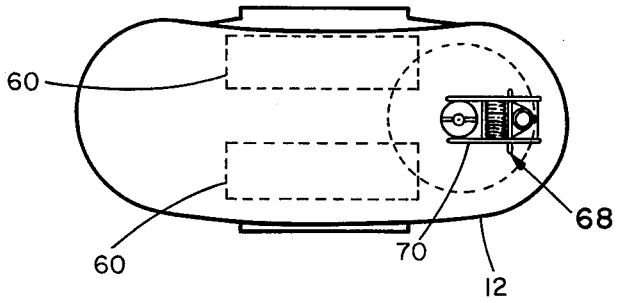
FIG. 5 shows a bottom view of the simulated canister of FIG. 1.

Canister 12 is substantially different inside than operational canister 20. As shown in FIG. 4 and FIG. 5, the primary members are filters 60. They may be standard military issue gas mask filters, such as GSA Stock No. 2H4240-00-218-0779 from Acushnet Corporation of New Bedford, MA. under Model DHAA15-69-C-0953. Preferably the filters are removable as by clamps 62. Canister 12 is made to the size, shape and weight of operational canister 20 and is similarly activated. A lanyard is provided with operational canister 20 to initiate the chlorate candle. A lanyard is likewise provided with canister 12, but to operate pushrod 64 and open valve 66. Thereby, fresh air may flow through filters 60 and valve 66 into fixture 18 of the breathing bag assembly, and from there through cross-over 10 into inhalation tube 30.

When cotter pin 68 is withdrawn by use of the lanyard, spring biased mechanism 70 forces pushrod 64 to rotate lever 72 and open valve 66. An end portion of lever 72 forms the cap to valve 66 and when lever 72 is rotated the cap rotates away, opening the valve to permit fresh air to flow upwards from filters 60 and through valve 66.

The final member associated with canister 12 that completes the modification of the OBA is collar 80, shown in FIG. 2. Collar 80 closes off breathing bag tube 24 at fixture 18. The normal flow of air through the neck of the canister is thereby prevented. Inasmuch as the simulator is not a closed loop, self-contained system, the air exhaled by the wearer is not recirculated but is, instead, vented to ambient through valve 54. Valve 54 provides resistance sufficient to inflate the breathing bag, for realism in both breathing effort and appearance of the apparatus.

An additional resistive valve has also been found to be a worthwhile feature in the simulators. It is a safety feature that is intended to provide at least some air to the facepiece even when the simulator is used improperly. After all, training is intended to prevent injury, not cause suffocation. The valve may be located anywhere along the inhalation path, and need not be a valve at all, since even a simple orifice will do. Resistance should be provided to restrict air flow and thereby warn the trainee that the "apparatus" is not being used properly. A preferred placement of the orifice is in the cap of lever 72 that covers valve 66. It has been suggested that the cap of lever 72 can be blocked open to prevent it from fully closing valve 66, which will permit at least some air flow at all times.

The present invention is not limited to the Type A-3 OBA. The invention was originated for the Type A-3 but it has application to other breathing apparatuses. Possible applications extend beyond emergency OBA's, to diving equipment, high altitude equipment, and some medical equipment, among others. The particular equipment selected for simulation will dictate design considerations, but the techniques disclosed by description or example provide the teaching to apply the invention to the various applications.

Obviously many modifications and variations of the present invention are possible in light of the above teachings. It is, therefore, to be understood that within the scope of the appended claims the invention may be practiced otherwise than as specifically described.

What is claimed is:

1. An apparatus that can be utilized as a simulator of a breathing apparatus, comprising:

a facepiece for placement in covering relationship to the nose and mouth of a wearer;

conduit means coupled to said facepiece for conveying gaseous fluid to and from said facepiece;

first and second aperture means coupled to said conduit means, communicating ambient atmosphere to said conduit means, and said conduit means to the ambient atmosphere, respectively;

means providing one-way flow from said first aperture means through said conduit means and one-way flow from said conduit means through said second aperture means;

means occupying said first aperture means for filtering the atmosphere communicated through said first aperture means;

an inflatable bag member coupled to said conduit means and communicating with said second aperture means;

means occupying said second aperture means for resistively venting said conduit means to said ambient atmosphere while maintaining a predetermined pressure within said bag member;

such that air is drawn through said filtering means and conveyed to said wearer when said wearer inhales, and said bag member is pressurized when said wearer exhales, and said conduit means is vented when the pressure within said bag member exceeds the predetermined resistance of said venting means.

2. A breathing apparatus simulator that comprises:

a facepiece having a manifold member attached thereto with a first branch of said manifold having a flapper valve that blocks the passage of air flow away from said facepiece, and a second branch of said manifold having a flapper valve that blocks the passage of air flow toward said facepiece;

first and second conduits coupled to said first branch and said second branch, respectively, for conveying air to and from said manifold;

an inflatable bag member having an input port;

a detachable canister having an input aperture occupied by a filter and an output port;

a coupler having at least five apertures with the first and fourth apertures communicating, and the second and third apertures communicating, and the fifth aperture resistively vented;

wherein said first conduit is coupled diagonally through the second port of said coupler to the third port of said coupler, which is coupled to said output port of said canister; said second conduit is coupled diagonally through the first port of said coupler to the fourth port of said coupler, which is coupled to said inflatable bag; and said fifth aperture is externally vented from said coupler between said first port and said fourth port.

3. The apparatus of claim 2, wherein the output port of said canister is valved.

4. A method of modifying a conventional breathing apparatus as a breathing simulator for accommodating training on said breathing apparatus which includes a facepiece having inhalation and exhalation ports, a recharging means coupled to the exhalation port for oxygenating the exhausted breath of the user, and a bag member coupled between the recharging means and the inhalation port, wherein said method comprises the steps of modifying said breathing apparatus to include filtering means in place of said recharging means that communicates air from outside said breathing apparatus into said breathing apparatus, and providing a cross-over means coupled to said filtering means, said bag member and said inhalation and exhalation ports, for communicating said filtering means to said inhalation port, and said bag member to said exhalation port, wherein the air flow path within the bag member of said conventional apparatus is reversed in said simulator.

5. The method of claim 4, wherein said apparatus has an inhalation conduit coupled between said facepiece and said bag member and an exhalation conduit coupled between said facepiece and said recharging means, and said cross-over means is a four port device comprised of channeled block members which render diagonally opposed ports communicative, wherein said inhalation conduit is coupled to a first port diagonally opposed from a fourth port which is coupled to said filtering means and said exhalation conduit is coupled to a second port diagonally opposed from a third port which is coupled to said bag member.

6. The method of claim 4, wherein said cross-over means further comprises a relief valve which is a pressure governing mechanism to vent pressure that exceeds a predetermined threshold.

7. The method of claim 4, wherein said recharging means is a chemical filled, replaceable canister and said filtering means of the simulator is a replaceable canister duplicative in size, shape and weight to said chemical filled canister, with at least one aperture to the outside air occupied by a filter.

8. The method of claim 7, wherein the canister used in said apparatus includes a lanyard for activating the oxygen generating mechanism of said canister and said simulator canister also includes a lanyard, wherein said simulator canister further includes a valve, push-rod and spring biased actuator responsive to the removal of said lanyard such that said actuator is released to apply force to said push-rod and open said valve.

* * * * *